United States Patent [19]

Murakami et al.

[11] 3,950,928

[45] Apr. 20, 1976

[54] DRAW-TEXTURING APPARATUS

[75] Inventors: Shiro Murakami; Kikuo Hori, both of Matsuyama, Japan

[73] Assignee: Teijin Limited, Osaka, Japan

[22] Filed: May 6, 1975

[21] Appl. No.: 574,891

Related U.S. Application Data

[63] Continuation of Ser. No. 477,368, June 7, 1974, abandoned.

[30] Foreign Application Priority Data

June 12, 1973 Japan ..... 48-68635[U]
Apr. 10, 1974 Japan ..... 49-40757[U]

[52] U.S. Cl. ..... 57/34 HS; 57/52; 57/53

[51] Int. Cl.[2] ..... D02G 1/02

[58] Field of Search ..... 57/34 R, 34 HS, 36, 57/52, 53, 90, 157 TS, 1 R

[56] References Cited

UNITED STATES PATENTS

| | | | |
|---|---|---|---|
| 3,043,083 | 7/1962 | Noguera | 57/36 |
| 3,070,948 | 1/1963 | Tsuzuki | 57/36 |
| 3,165,881 | 1/1965 | Moncuit et al. | 57/34 HS |
| 3,367,096 | 2/1968 | Comer et al. | 57/34 HS |
| 3,564,829 | 2/1971 | Tsuzuki | 57/36 |
| 3,773,191 | 11/1973 | Ishida | 57/52 X |

*Primary Examiner*—John Petrakes
*Attorney, Agent, or Firm*—Burgess Ryan and Wayne

[57] ABSTRACT

Draw-texturing for synthetic fibers is efficiently carried out by means of a draw-texturing apparatus having a novel arrangement and construction wherein the draw-false-twisting body proper is arranged through and beyond an intermediate floor. Package supply means are located on said intermediate floor in opposing relation in the upper portion of said body proper, a first operational floor is formed between said package supply means and the upper portion of said body proper, take-up means are placed on the apparatus base floor in opposing relation in the lower portion of said body proper and a second operational floor having yarn passages underneath is formed between the lower portion of said body proper and said take-up means.

6 Claims, 8 Drawing Figures

DRAW-TEXTURING APPARATUS

This is a continuation of application Ser. No. 477,368, filed June 7, 1974, now abandoned.

SUMMARY OF THE INVENTION

The present invention is an improved draw-texturing apparatus of a pending patent application Ser. No. 404,643 filed on Oct. 9, 1973, which has been assigned to the same assignee, Teijin Limited in Japan. Therefore, the present invention relates to an improved draw-texturing apparatus producing false twisted bulky yarns directly from undrawn yarns of synthetic fibers. (The term "undrawn yarns" as used herein is defined as including partially drawn yarn.)

Recently, in an attempt to reduce production costs, bulky yarns are being produced directly from undrawn yarns of synthetic fibers by concurrently drawing undrawn yarns and false-twisting the same. The apparatus to practice such a method, i.e., the draw-texturing apparatus, in general comprises three parts: (i) package supply means, mounting yarn packages thereon; (ii) draw-false-twisting section, composed of supply rollers adapted to supply undrawn yarns to a draw-false-twisting portion, a first heater, false-twisting means, a first delivery roller adapted to draw or stretch yarns, said first delivery roller having a peripheral speed greater than that of said supply roller, a second heater, a second delivery roller, etc., and; (iii) take-up means adapted to take up yarns around the surface of a bobbin.

A simple vertical arrangement of these three parts, i.e., package supply means, draw-false-twisting section and take-up means, will result in an increase in the height of an apparatus and, consequently, in extreme difficulties, with the yarn threading-up operation. To avoid such difficulties, it has been a general practice to provide a simple false-twisting machine, as disclosed in U.S. Pat. No. 3,165,881, of such a construction that the body proper of the apparatus is in an opposing relation to the package supply means and take-up means. With such an arrangement yarns are introduced from the upper and lower portions of the apparatus into the package supply means and take-up means opposing the body proper of the apparatus. However, such a draw-texturing apparatus still has a height greater than that of the conventional simple false-twisting machine and difficulties with the threading-up operation remain. As a result, there is a demand for improvements which will make easier the threading-up operation and associated operations required for the draw-texturing apparatus.

In the above-mentioned copending patent application, a draw-texturing apparatus adapted for practical use, which eliminates the drawbacks encountered with the aforesaid threading-up operation and other associated operations required for the conventional draw-texturing apparatus is disclosed. This draw-texturing apparatus comprises: a body proper extending from the apparatus base floor through and beyond an intermediate floor; package supply means located on said intermediate floor in opposing relation to the upper portion of said body proper; a first operational floor between said package supply means and the upper portion of said body proper; take-up means placed on said base floor in opposing relation to the lower portion of said body proper; a second threading-up operation floor positioned between said take-up means and the lower portion of said body proper, and; yarn passages leading from the underside of said threading-up operation floor to the take-up means.

As the creeling operation for mounting yarn packages on the respective creels of the draw-texturing apparatus consumes considerable man power, it is further required to reduce manual operations to save on production costs. Therefore, it is the principal object of the present invention to provide a draw-texturing apparatus wherein manual operations in the creeling operation or threading-up operation is capable of being reduced considerably.

Other objects and features of the present invention will more fully appear from the following description and the accompanying drawings and will be particularly pointed out in the claims appended hereto.

DETAILED DESCRIPTION OF THE PREFERRED EMBODIMENTS

Figure 1:
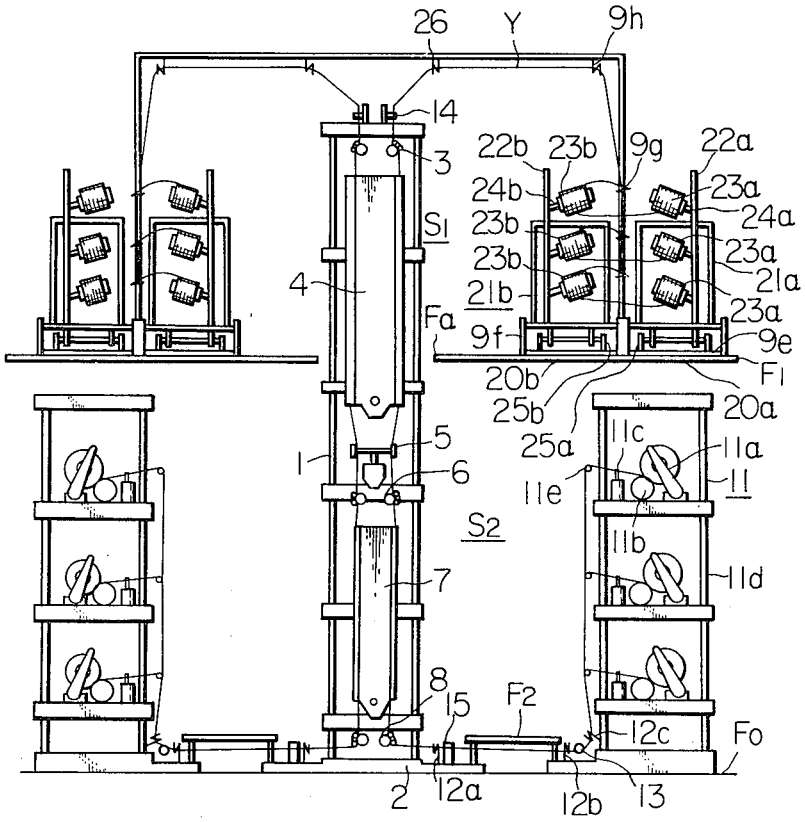
FIG. 1 is a side elevational view of a draw-texturing apparatus of the present invention.
Figure 2:
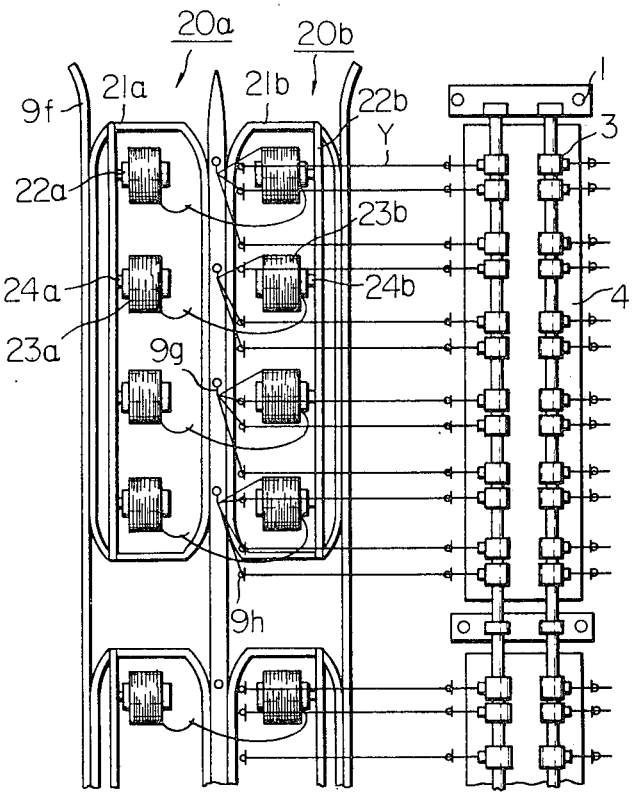
FIG. 2 is a plan view of the draw-texturing apparatus of the invention showing the portion above the intermediate floor of FIG. 1.
Figure 3:
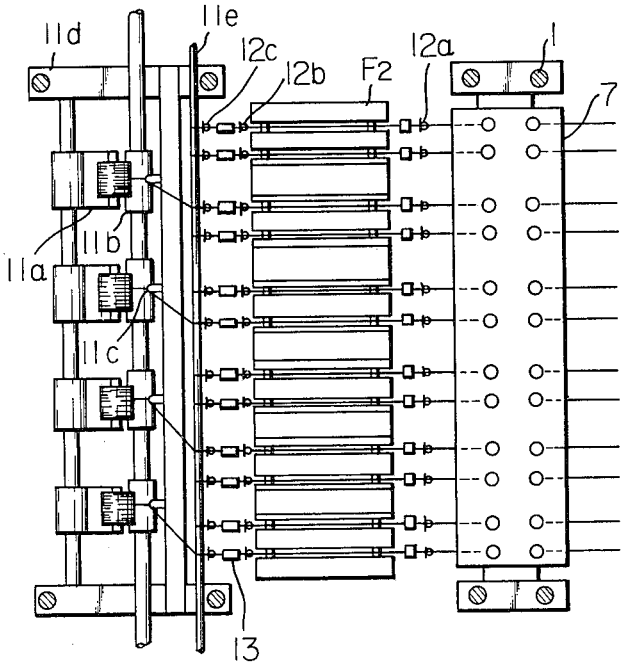
FIG. 3 is a plan view of the draw-texturing apparatus of the invention, showing the lower portion thereof.

Referring now to FIGS. 1, 2 and 3, the numeral 1 denotes a frame of the body proper extending upwardly from a basic frame 2 located on a base floor Fo, with the upper portion of said frame protruding above the intermediate floor F1 located above said base floor Fo.

The body proper of the apparatus of the invention consists of supply rollers 3 supported on the transverse frames mounted horizontally on said frame 1, a first heater 4 of contact type, two false-twisting means 5 such as false-twisting spindles, two first delivery rollers 6, a second heater 7 of noncontact type and two second delivery rollers 8, all being disposed on said frame 1. Such an arrangement does not present a substantial change in construction from the conventional simple false-twisting machine. However, since the first heater 4 as well as the second heater 7 have lengths greater than 1 meter, and a cooling zone of a length of 0.5 to 1 meter is necessary between the first heater 4 and the false-twisting means 5, the height of the apparatus will be about 5 meters, when measured from the set-up floor Fo to the top of the apparatus. The false-twisting means may include, for example, a false-twisting spindle unit, friction twist type false-twisting unit or fluid jet type false-twisting unit.

As shown in FIG. 1, there are provided truck transferring passages 20*a* and 20*b* on the intermediate floor F1. Said passages 20*a* and 20*b* comprise running boards 9*e* and side guides of 9*f* adapted to govern the position of a truck. Shown at 21*a* and 21*b* are creel trucks which are provided with pegs 24*a* and 24*b* in stages, said pegs being adapted to hold the yarn packages 23*a* and 23*b* thereon, while said trucks are provided with wheels 25*a* and 25*b* on the underside thereof which run on said running boards. In this embodiment, there are provided two routes of truck transferring passages 20*a* and 20*b*. Provided between said transferring passages are yarn drawing guides 9*g* corresponding to the packages, respectively, and there is provided yarn guides 9*h* above said yarn packages. The first space S1 defined between the upper portion of the body proper and the truck transferring passages 20*a* and 20*b* is used for the first threading-up operation, and a portion of the intermediate floor F1 directly under the first space S1 is used as the first threading-up operation floor Fa. As a result, the undrawn yarn Y, which is being withdrawn from the respective yarn package mounted on the creel trucks adapted to be transferred on the truck transferring passages 20*a* and 20*b*, is led through the yarn drawing guides 9*g* provided midway of said both truck transferring passages and then through the yarn guide 9*h* which is provided above the truck transferring passages, then above the first operational space S1, then into the supply guide 26 on the body proper of the apparatus and eventually to the supply roller 3. Then, the transfer tail of the yarn package 23*b* mounted on the truck 21*b* is tied up with the end of the yarn from the yarn package 23*a*. Upon completion of the withdrawal from the respective yarn package 23*b*, the respective yarn package 23*a* mounted on the truck 21*a* will be transferred. When the yarn on said yarn package is all paid out, then another truck carrying a full yarn package thereon is transferred in place of the former truck, thus repeating the operation as has been described before. There is provided a yarn cutter 14 between the supply guide 26 and the supply roller 3.

Take-up means 11 are located on the apparatus base floor Fo in opposing relation to each other in the lower portion of the body proper. The take-up means comprises, on a frame 11*d*, bobbin holders 11*a* adapted to hold the take-up bobbins thereon, friction rollers 11*b* of a line shaft system, which rollers 11*b* are adapted to frictionally drive the take-up packages, and traverse guides 11*c* adapted to transversely pay out yarns thereover. The take-up units are arranged in two or three stages, three being shown in FIG. 1. The threading-up operation of yarns around each take-up unit is carried out from the front of the take-up unit in the second threading-up operational space S2 defined between the lower portion of the body proper and the take-up means 11, while the removal of the complete package, i.e., so called doffing, is accomplished from the rear of the take-up means.

Located in the second threading-up operational space S2 is a second threading-up operation floor F2, and the yarn passage or route leading from the second delivery roller to the take-up means 11 is located beneath the said operation floor F2. Accordingly, yarn guides 12*a* and 12*b* are placed adjacent to and under the operation floor F2, whereby the yarn is led from the second delivery roller 8, past the guides 12*a* and 12*b* and then upwardly from said guide 12*b* into the inlet guide 11*e* of each take-up unit. The yarn is then transversely paid out by the traverse guide 11*c* to thereby form a package. There is also provided a yarn-breakage detecting means 15 between guides 12*a* and 12*b*. Slits are formed on the operation floor F2 to provide a yarn passage to permit the smooth threading-up operation above said operation floor. (In FIG. 1, 13 represents an oiling means.) Likewise, the yarn passage leading from the package supply truck 9 to the supply roller 3 is provided above the first threading-up operation floor Fa, thereby permitting smooth and quick operation in the first threading-up operation space S1.

The draw-false-twisting units are provided for the draw-texturing apparatus on the opposite sides of the body proper thereof along the length of said body proper. Likewise, pegs on the package supply means and take-up units are provided, corresponding to said draw-false-twisting units, along the length of said package supply means and the frame of the take-up means.

In the threading-up operation in the aforesaid draw-texturing apparatus, an operator on the first operation floor Fa draws a yarn from the yarn package on the package supply creel truck 9 and then introduces the same, in turn, through the guide 9*d*, supply guide 10, supply roller 3 and first heater 4 to the underside of the operation floor Fa. The yarn thus withdrawn is introduced by another operator on the operation floor F2 in the second threading-up operation space S2 into the false-twisting means 5, first delivery roller 6, second heater 7, second delivery roller 8, past the guides 12*a* and 12*b* and then around the bobbins of respective take-up units, thus completing the threading-up operation. Alternately, the yarn drawn from the yarn package on the creel truck on the floor F1 may be introduced through the guide 9*d* and, by an arrangement similar to above, through the underside of the operation floor Fa to the supply guide 10.

The above-mentioned draw-texturing apparatus is provided with a special designed threading-up means, means for controlling the operational speed of the draw-texturing apparatus to a speed lesser than the normal operation speed thereof at the time of the threading-up operation, yarn breakage detecting means, specially designed second heater, a sound proof cover disposed at the false-twisting spindle portion of the draw-texturing apparatus, which is similar to the draw-texturing apparatus disclosed in the above-mentioned copending application.

Figure 4:
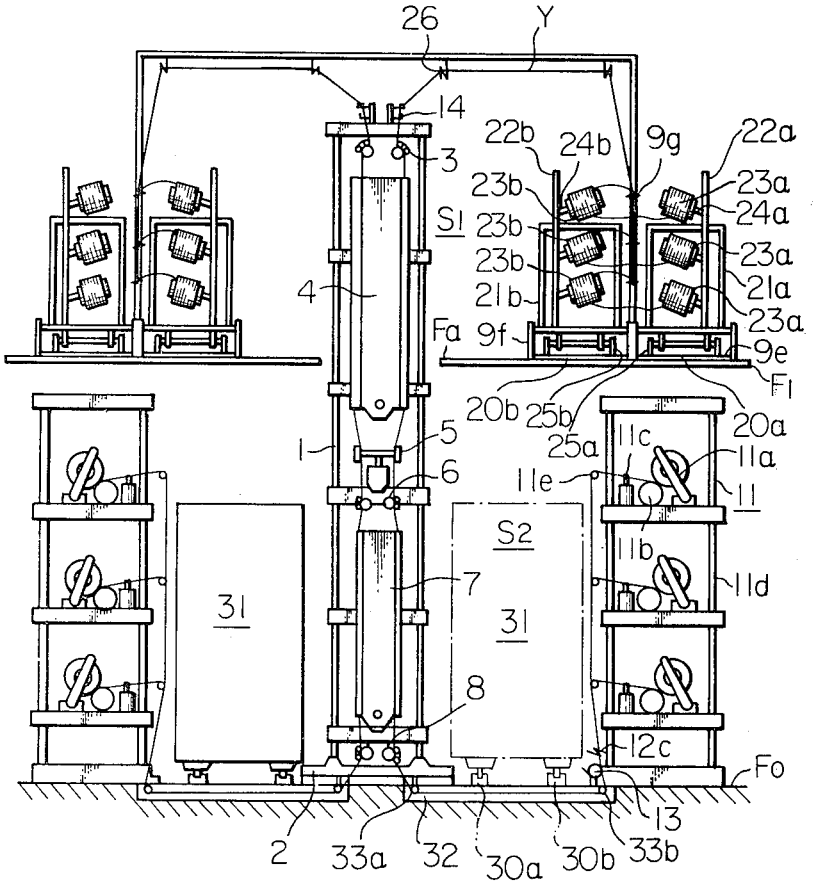
FIG. 4 is a side elevational view of another draw-texturing apparatus according to the present invention.
Figure 5:
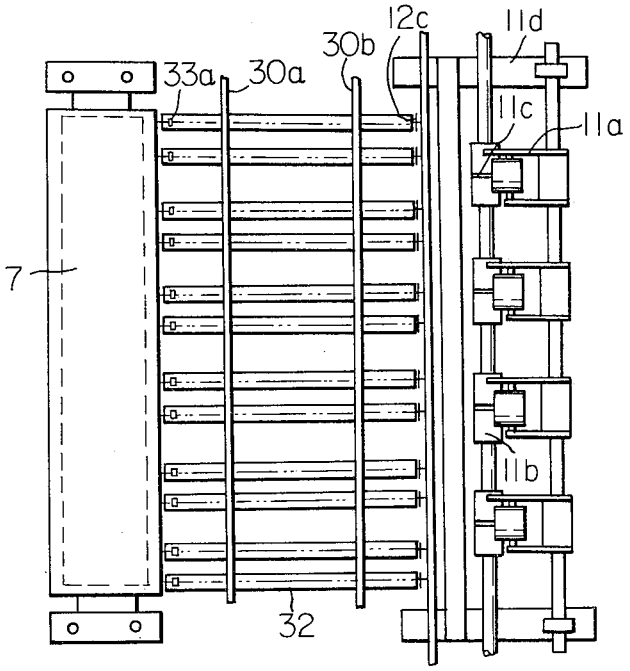
FIG. 5 is a schematic plan view of a lower portion of the draw-texturing apparatus, shown in FIG. 4.
Figure 6:
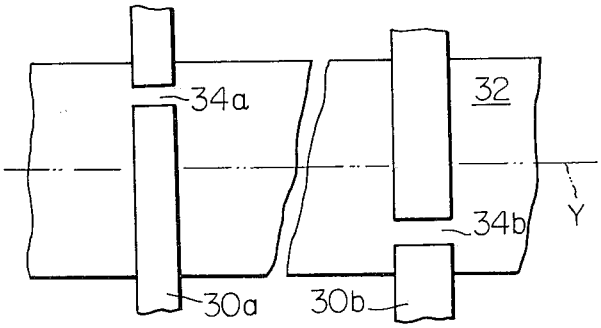
FIG. 6 is a schematic plan view of a part of floor between the body proper and the take-up means of the draw-texturing apparatus shown in FIG. 1.

Recently, an automatic apparatus for doffing full yarn packages from the take-up means 11 has been introduced to save on manual costs. The second embodiment shown in FIG. 4 shows a particular draw-texturing apparatus utilizing the automatic doffing apparatus. The construction of this second embodiment is quite similar to the first embodiment shown in FIGS. 1, 2 and 3, except the yarn guide passage formed between the body proper and the take-up means. Therefore, the elements having the same functions as the second embodiment are designated by the reference numerals similar to the first embodiment, and the portions different from the first embodiment are only explained hereinafter. In this second embodiment, a pair of guide rails 30*a*, 30*b* are mounted on the base floor Fo at the respective bottom positions of the second threading-up operation space S2 so that the above-mentioned automatic doffing device 31 is capable of displacing along the guide rails 30*a*, 30*b*. A plurality of grooves 32 are formed in the floor Fo beneath the guide rails 30*a*, 30*b* as shown in FIG. 4. A pair of guide rollers 33*a*, 33*b* are rotatably mounted underneath the body proper and the frame of the take-up means 11 in each groove 32 as shown in FIG. 5. Consequently, the yarn Y is capable of passing through the corresponding groove 32 by way of the guide rollers 33*a*, 33*b* from the second delivery roller 8 to the take-up means 11. The guide rails 30*a*, 30*b* are provided with small cut-off portions 34*a*, 34*b* respectively at positions above each groove 32, as shown in FIG. 6 so that, when the yarn Y is threading-up through the groove 32, the yarn Y is easily put into the groove 32 by passing through the cut-off portions 34*a*, 34*b*. To prevent any disturbance of the smooth running of the automatic doffer 31 along the guide rails 30*a*, 30*b* which may be created by the cut-off portion 34*a* (34*b*) of each guide rail 30*a* (30*b*), the cut-off portions 34*a*, 34*b* are positioned in biased condition each to the other with respect to the yarn passage in each groove 32 as shown in FIG. 6. Further, it is preferable to cover the grooves 32 to keep the yarn passage of each groove 32 clean by utilizing a suitable cover plate (not shown).

In the above-mentioned explanation of the invention, the novel principle of forming a yarn passage through the draw-texturing apparatus is applied to the draw-texturing on the simultaneous process. However, this principle can be satisfactorily applied to draw-texturing on the sequential process. That is, in the above-mentioned embodiments of the present invention, the drawing section may be formed at a portion of the yarn passage which is upstream to the first heater.

Figure 7:
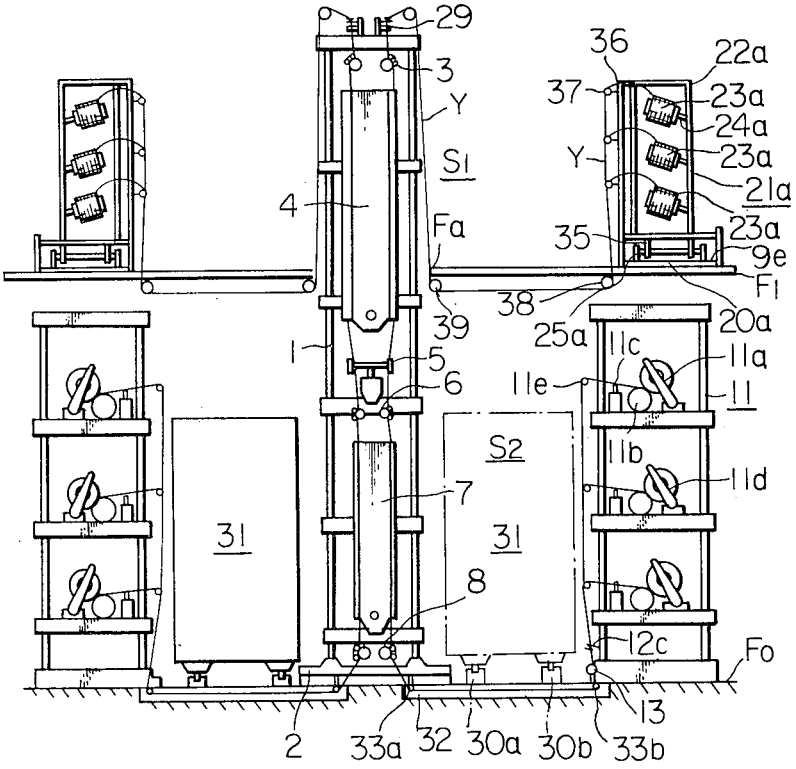
FIG. 7 is a side elevational view of another draw-texturing apparatus according to the present invention.
Figure 8:
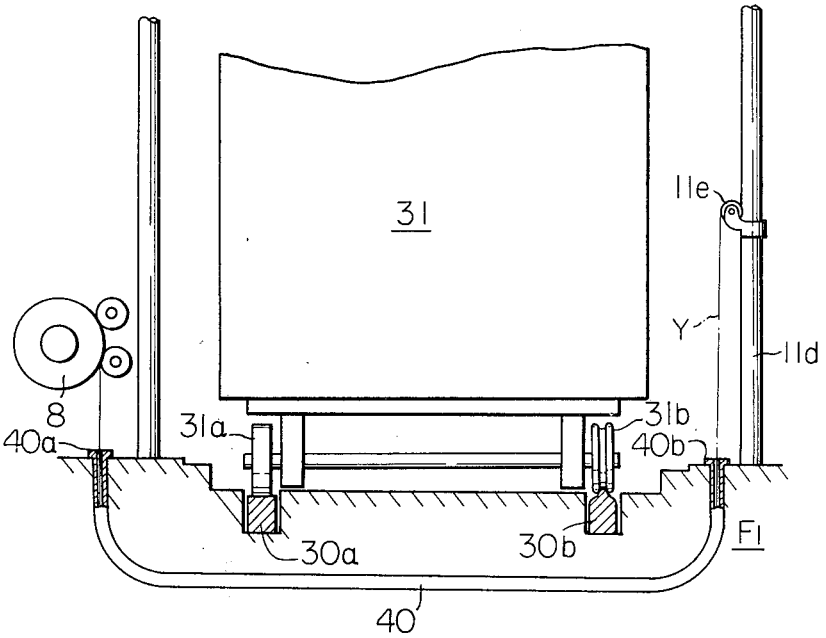
FIG. 8 is a side sectional view of yarn guide means disposed between the body proper and the take-up means of the draw-texturing apparatus according to the present invention.

A further modified embodiment of the draw-texturing apparatus according to the invention is shown in FIG. 7, wherein a single route for use as a creel truck transferring passage is provided. In this embodiment, when the yarn supply package becomes empty, the apparatus is stopped, another truck carrying a full yarn package thereon is transferred to the place of the former truck, the end of the yarn already in the apparatus is tied up with the end of the yarn from the yarn package on the newly supplied creel truck, and then, the operation of the apparatus is again started. This draw-texturing apparatus has a construction rather similar to the above-mentioned second embodiment shown in FIG. 4, except for the use of yarn guide means between the creel truck 35 and the supply roller 3. That is, in this embodiment, an upright creel stand 36 is mounted on the intermediate floor F1 and a plurality of yarn guides 37 are supported by the stand 36. A pair of guide rollers 38, 39 are rotatably mounted underneath the floor F1 as shown in FIG. 7. Yarn guide slits (not shown) are formed in the floor F1 at a position above the guide roller 38, and the guide roller 39 is mounted adjacent to the body proper of the texturing apparatus from the free edge of the floor F1. Therefore, the yarns Y from the yarn packages 23*a* mounted on the creel truck 35 are capable of feeding to the texturing apparatus by way of the yarn guides 37, the yarn guide slits, and guide rollers 38 and 39. In the above-mentioned embodiment, it is also useful to apply a yarn guide pipe (not shown) disposed underneath the floor F1 instead of the above-mentioned guide rollers 38 and 39. In this case, the yarn from the package 23*a* is introduced into each yarn guide pipe (not shown) by applying suction air. Therefore, when a yarn end is introduced into the guide pipe, the yarn is carried to a discharge aperture thereof facing the body proper of the texturing device by a suction air force. This principle is also useful to apply the yarn passage formed at the bottom portion of the second operational space S2 of the present invention. That is, a yarn guide pipe 40 is disposed in the floor F1 as shown in FIG. 8, in such a condition that an inlet aperture 40*a* and an outlet aperture 40*b* face the second guide roller 8 and the yarn passage toward the take-up means 11.

As is apparent from the foregoing description, according to the draw-texturing apparatus of the invention, particularly with reference to the supply means for undrawn yarn package and threading-up means, the threading-up operation in the draw-texturing apparatus can be accomplished in a highly economical manner without any trouble.

What is claimed is:

1. In a draw-texturing apparatus for synthetic fibers comprising a roller for supplying an undrawn yarn, a first heater, a false-twisting means for imparting twist to the yarn, a first delivery roller rotating at a peripheral speed greater than that of the supply roller and drawing and supplying the yarn, a second heater and a second delivery roller advancing the yarn to a take-up means, a main body having a supporting frame at said first heater, said false twisting means, said first delivery roller, and said second heater, an intermediate horizontal floor disposed at substantially middle level of said main body, and a base floor for installing said apparatus; the improvement comprising package supply means located on said intermediate floor in opposing relation in the upper portion of said main body, a first floor between said package supply means and the upper portion of said main body for forming a first operational space, take-up means on the apparatus base floor in opposing relation in the lower portion of said main body and a second operational space between the lower portion of said main body and said take-up means, a yarn passage between said main body and said take-up means formed under said second operational space , said base floor having an intermediate portion formed between said main body and said take-up means; said yarn passage being beneath said intermediate portion, said package supply means being composed of at least one creel truck and a truck transferring passage mounted on said intermediate floor on which said creel truck moves.

2. A draw-texturing apparatus according to claim 1, comprising an automatic doffing device which is capable of doffing full yarn packages from said take-up means, each of said intermediate floor portions having guide rail means for guiding said doffing device, and said guide rail means has cut off portions for threading up the treated yarn from a side of said second operational space into said yarn passage.

3. A draw-texturing apparatus according to claim 1, wherein said yarn passage is a yarn guide pipe disposed in said base floor.

4. A draw-texturing apparatus according to claim 1, further comprising yarn guide means positioned above said intermediate floor for leading undrawn yarn from said package supply means to said supply roller.

5. The draw-texturing apparatus of claim 1 wherein said intermediate portion comprises a second floor at a bottom portion of said second operational space.

6. In a draw-texturing apparatus for synthetic fibers comprising a roller for supplying an undrawn yarn, a first heater, a false-twisting means for imparting twist to the yarn, a first delivery roller rotating at a peripheral speed greater than that of the supply roller and drawing and supplying the yarn, a second heater and a second delivery roller advancing the yarn to take-up means, a main body having a supporting frame at said first heater, said false twisting means, said first delivery roller, and said second heater, an intermediate horizontal floor disposed at substantially middle level of said main body, and a base floor for installing said apparatus; the improvement comprising package supply means located on said intermediate floor in opposing relation in the upper portion of said main body, a first floor between said package supply means and the upper portion os said main body for forming a first operational space, take-up means on the apparatus base floor in opposing relation in the lower portion of said main body and a second operational space between the lower portion of said main body and said take-up means, a yarn passage between said main body and said take-up means formed under said second operational space, said package supply means being composed of at least one creel truck and a truck transferring passage mounted on said intermediate floor on which said creel truck moves, said intermediate floor being provided with a plurality of yarn guide passages formed underneath thereof, whereby yarns from said package supply means may be led to the respective supply rollers by way of said yarn guide passages.

* * * * *